US005821207A

United States Patent [19]

Kanai et al.

[11] Patent Number: 5,821,207

[45] Date of Patent: Oct. 13, 1998

[54] METHOD FOR PRODUCING FINE SOLID BUILDER PARTICLE

[75] Inventors: Hiroyuki Kanai; Mikio Sakaguchi; Shu Yamaguchi, all of Wakayama, Japan

[73] Assignee: Kao Corporation, Tokyo, Japan

[21] Appl. No.: 750,489

[22] PCT Filed: Jun. 5, 1995

[86] PCT No.: PCT/JP95/01105

§ 371 Date: Dec. 11, 1996

§ 102(e) Date: Dec. 11, 1996

[87] PCT Pub. No.: WO95/34623

PCT Pub. Date: Dec. 21, 1995

[30] Foreign Application Priority Data

Jun. 15, 1994 [JP] Japan ..... 6-158013

[51] Int. Cl.[6] ..... C11D 3/12; C11D 10/02; C11D 11/00; C11D 17/06

[52] U.S. Cl. ..... 510/531; 510/349; 510/356; 510/360; 510/438; 510/441; 510/443; 510/444; 510/505; 510/506; 510/507; 510/511; 510/532

[58] Field of Search ..... 510/531, 532, 510/508, 511, 441, 438, 445, 407, 413, 418, 505, 506, 349, 356, 360; 252/246

[56] References Cited

U.S. PATENT DOCUMENTS

| | | | |
|---|---|---|---|
| 3,962,132 | 6/1976 | Haschke et al. | 252/179 |
| 4,126,574 | 11/1978 | Reinwald et al. | 510/532 |
| 4,280,920 | 7/1981 | Garvey et al. | 510/532 |
| 4,336,234 | 6/1982 | Leutner et al. | 423/714 |
| 4,606,503 | 8/1986 | Bleeck | 241/16 |
| 4,664,839 | 5/1987 | Rieck | 252/175 |
| 4,732,880 | 3/1988 | Ugo et al. | 510/532 |
| 4,820,439 | 4/1989 | Rieck | 510/531 |
| 4,925,586 | 5/1990 | Baker et al. | 510/297 |
| 5,108,646 | 4/1992 | Beerse et al. | 510/531 |
| 5,399,297 | 3/1995 | Panthal et al. | 510/451 |

FOREIGN PATENT DOCUMENTS

| | | |
|---|---|---|
| 57-61616 | 4/1982 | Japan . |
| 95/05445 | 2/1995 | WIPO . |

OTHER PUBLICATIONS

English translation of JP 57–61616, published Apr. 14, 1982.

English translation of JP 57–73097, published May 7, 1982.

English translation of WO 90/01458, published Feb. 20, 1990.

PCT Search Report for PCT/JP95/01105, dated Sept. 12, 1995.

*Primary Examiner*—Ardith Hertzog

*Attorney, Agent, or Firm*—Birch, Stewart, Kolasch & Birch, LLP

[57] ABSTRACT

The method for producing a fine solid builder particle includes the steps of suspending a solid builder in a dispersion medium containing 20 to 100% by weight of a surfactant, and carrying out wet grinding of the solid builder. The builder composition containing the fine solid builder particle is obtainable by the above method. The detergent composition containing the fine solid builder particle is obtainable by the method. The method for producing a detergent composition includes the steps of carrying out wet grinding of a solid builder using a dispersion medium containing a surfactant to give a mixture of a fine solid builder particle and the surfactant, and further adding the mixture to a composition for a detergent.

16 Claims, 2 Drawing Sheets

METHOD FOR PRODUCING FINE SOLID BUILDER PARTICLE

TECHNICAL FIELD

The present invention relates to a method for producing fine solid builder particle having improved performance as a builder, a builder composition and a detergent composition containing the fine solid builder particle, and a method for producing the above detergent composition.

BACKGROUND ART

Solid builders typically exemplified by zeolites have been most generally used as calcium ion capturing agents for use in detergents today.

Zeolites, when used as solid builders, are likely to be precipitated in washing tubs and drain pipes due to the insolubility in water, so that much attention has to be paid to their dispersibility. Therefore, studies have been so far made to improve the dispersibility by making the solid builder particles fine. Nowadays, the most widely used zeolite is ZEOLITE-A which is produced to have a primary particle size of about 3 μm. There are substantially no practical problems in water dispersibility of builders by adjusting the particle size of the primary particles to about 3 μm (though the particle size of aggregates thereof being somewhat larger). As mentioned above, in the prior art, it has been studied how to make the solid builder particles fine in order to improve their dispersibility, and it has reached a level with substantially no practical problems. On the other hand, it has been known that a cation exchange speed and a specific surface area are correlated, and from this viewpoint further studies have been made for producing finer particles.

However, in the prior art, when attempts are to be made to further make the solid builder particles fine in order to improve their calcium ion capturing ability, crystallization of the solid builders become difficult. Therefore, since the solid builders have to be kept under strict control, the production costs become expensive. Moreover, the obtained primary particles are likely to be agglomerated.

For instance, methods for preparing zeolites in forms of fine particle crystals by selecting suitable reaction conditions are disclosed in Japanese Patent Laid-Open Nos. 50-70289 (DE-A-2333068) and 51-84790 (DE-A-2447021) and Japanese Patent Examined Publication Nos. 59-4376, 2-4528, and 4-55976. However, in all these methods, it is economically disadvantageous to prepare particles which are well crystallized and have a particle size of 0.5 μm or less. In fact, there are some zeolites commercially available as products having a primary particle size of about 1 μm in the primary particles by the method of producing fine particle crystals mentioned above. However, these products are considerably more expensive than general zeolites having a primary particle size of about 3 μm.

Also, when a zeolite suspended in a dispersion medium comprising water as a main component is ground in a state of slurry, the crystal structure thereof is broken, so that the calcium ion exchange capacity is drastically deteriorated. Although attempts have been made to improve the dispersibility of the zeolites by giving shear force to the water slurry upon the production of zeolite, it has been difficult to achieve a high calcium ion exchange capacity even if fine particles were produced by giving stronger grinding force to the slurry after maturing the zeolite.

On the other hand, silicate compounds, such as SKS-6 (sodium silicate: $Na_2Si_2O_5$) made commercially available by Hoechst AG, have similarly good calcium ion capturing ability as the zeolites, and their applications for detergent builders have been studied. Crystalline alkali metal silicate compounds typically exemplified by SKS-6 are supplied in a powder form having a particle size distribution mainly in the range of from about 20 to 100 μm. The silicate compounds are known to have a property that when the silicate compounds are placed in water, they are naturally broken into considerably fine particles (volume mean particle size being about 4 μm). Also, when compared with the above zeolites, the silicate compounds have relatively small problem in forming precipitates in the drain pipes because of their superior dispersibility. However, there are the following problems in making solid builder particles fine to improve the calcium ion capturing ability. In the case where zeolites are produced by precipitating crystals from a starting material solution, the finer the crystals are, the lower the crystallinity becomes, so that the builder properties, such as calcium ion capturing ability, are likely to be deteriorated.

Also, in the case where fine particles are obtained by grinding, the crystals are deteriorated mechanochemically, thereby causing to deteriorate its calcium ion exchange capacity. For instance, Japanese Patent Laid-Open No. 57-61616 discloses a method of grinding zeolites by a wet process using a fine zeolite aqueous suspension containing a slightly water-soluble nonionic surfactant and sodium silicate. This method is merely concerned with stability of a zeolite suspension, and builder properties are not satisfactory. Particularly in the case where a crystalline silicate is used, the calcium ion exchange capacity is drastically lowered, making it disadvantageous. In addition, according to this method, the water content is large so that ion exchange capacity is lowered upon grinding, and energy costs are high, making it further disadvantageous.

Furthermore, in the case of producing the silicate compounds obtained as a hard baked product with a particle size of 4 μm or less, an additional process of making the particles fine has to be carried out by grinding. However, such a grinding for producing finer particles is an extremely difficult process. For instance, when the above alkali metal silicate compound is ground using a "dry-type vibrating mill," which is a typical dry-type grinding method, the production of fine particles by a practical operation is limited to a production of particles having an average particle size of from about 4 to about 12 μm, and a production of further finer particles is difficult.

Further, in the case of the silicate compounds, there arises a problem of chemical stability. It has been known that the silicate compounds gradually change chemically by an action of water vapor or carbon dioxide in the air, thereby deteriorating the water softening properties when used as builders. The increase of specific surface area by making particles fine accelerates the deterioration of the water softening properties. In other words, production of fine particles rather causes various problems for detergent builders.

Therefore, even if a suitable method for making particles fine were able to be found, handling of powder in the grinding process and in the process for blending ground products to the detergents, and the process management would be difficult. Also, detergents formulated with the fine particles would possibly have poor affects in the performance stability with the passage of time.

DISCLOSURE OF THE INVENTION

An object of the present invention is to provide a method for producing a fine solid builder particle having an improved calcium ion capturing ability by making the particles fine.

Another object of the present invention is to provide a builder composition containing the above fine solid builder particle.

A still another object of the present invention is to provide a detergent composition containing the above fine solid builder particle.

A still another object of the present invention is to provide a method for producing the above detergent composition.

The present inventors have made various studies concerning the method for making solid builder particles fine in view of the above problems. As a result, they have found that particles having a particle size far smaller than the generally available builders can be easily produced at a low cost by suspending a solid builder in a dispersion medium containing a surfactant while substantially containing no water, and carrying out a wet grinding. In addition, they have found that fine particles having far improved performance in the resulting builder while showing substantially no deterioration in the calcium ion exchange speed can be obtained, when compared with those of before grinding. Further, they have found that detergents having remarkably superior detergency when compared with conventional detergents can be easily obtained by directly using the above builder for the detergents. Based on the above findings, the present invention has been completed after further studies.

Specifically, the present invention is concerned with a method for producing a fine solid builder particle comprising the steps of suspending a solid builder in a dispersion medium containing 20 to 100% by weight of a surfactant, and carrying out wet grinding.

BEST MODE FOR CARRYING OUT THE INVENTION

Figure 1:
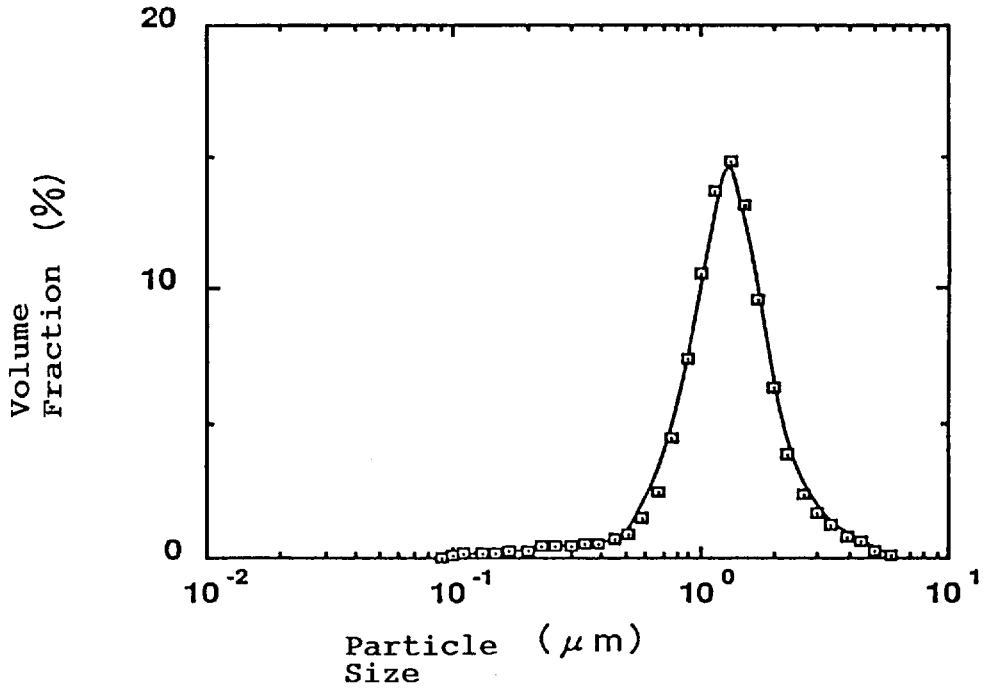
FIG. 1 is a graph showing the particle size distribution of the fine solid builder particle produced in Example 1.

The solid builder in the present invention is made fine by employing so-called a "wet grinding method." A conventionally known wet grinding method using a generally known liquid dispersion medium makes it possible to grind into even finer particles when compared with that employing a dry grinding method. Typical dispersion media used in the above wet grinding method include lower alcohols, such as ethyl alcohol and isopropyl alcohol; ketones, such as acetone and methyl ethyl ketone; and ethers such as ethyl ether. However, if the ground product is blended in a detergent product, a process of separating the liquid dispersion medium used in the wet grinding method, for instance, drying of powders, has to be employed, thereby making it industrially extremely disadvantageous. In addition, as mentioned above, particularly in the case of crystalline silicates, there arises a problem that calcium ion exchanging sites are undesirably likely to be deteriorated in the separation process. In the present invention, the above problem has been eliminated by using a surfactant in the dispersion medium as explained below.

As for wet grinding methods in the present invention, various generally known methods using media mill, roll mill, etc. can be employed. Particularly, a preference is given to a wet grinding method using a media mill, such as a sand mill, a sand grinder, a wet vibrating mill, and an attritor from the viewpoint of grinding efficiency. Examples of the milling media include any of conventionally used materials such as titania and zirconia.

In the case where the grinding is carried out using a sand mill, the diameter of the milling media is particularly suitably from 0.1 to 2.5 mm. In the case where the particle size of the solid builder used for a starting material is particularly large, the solid builder may be efficiently finely ground by previously subjecting to a dry grinding method to obtain a particle size suitable for preparing a slurry or by previously subjecting to a two-step grinding process, comprising subjecting to a wet grinding using media having a relatively large diameter, for instance, those having a diameter of 2 mm, and then subsequently subjecting to a wet grinding using media having a smaller diameter. The sand mill may be carried out both in a batch process or a continuous process, with a particular preference given to the sand mill in a continuous process from the viewpoint of giving a good yield.

The dispersion medium used in the wet grinding method for the solid builder in the present invention is a dispersion medium at least containing a surfactant. The surfactants may be chosen from wide variety of surfactants including nonionic surfactants, anionic surfactants, and cationic surfactants. The surfactants in a liquid form are highly preferred, because they may be also used for a dispersion medium without requiring a separate dispersion medium such as a solvent to be used together therewith, and thus not particularly necessitating a drying process. In certain cases, however, where the material is highly viscous depending upon the properties of the surfactants used, the dispersion medium may contain an inorganic solvent which is blended together with the surfactant. Examples of the organic solvents include lower alcohols having 1 to 4 carbon atoms such as methanol, ethanol, and isopropyl alcohol, ethylene oxide and/or propylene oxide adducts thereof, both having 1 to 5 molar number, and ethylene oxide and/or propylene oxide adducts of phenol; ketones such as acetone, methyl ethyl ketone, and cyclohexanone; and other general organic solvents such as toluene and ethers.

The above dispersion media substantially containing no water therein are suitably used. Here, "substantially containing no water" means that the dispersion medium does not contain water other than that contained in generally commercially available surfactants (for instance, in the case of nonionic surfactants, the water content being 1% by weight or less), and other than that contained in the solid builder as crystal water (for instance, in the case of aluminosilicates, the water content being about 20% by weight). When the dispersion medium substantially contains water, the performance as the builder is likely to be deteriorated upon grinding and during the drying process. Particularly in the case of silicate compounds, its calcium ion capturing capacity is likely to be undesirably lowered.

The amount of the surfactant used in the dispersion medium is from 20 to 100% by weight, preferably 50 to 100% by weight. Larger the proportion of the surfactants used is more desirable, and a greatest preference is given to a dispersion medium consisting of detergent components alone without containing the above organic solvents. When the amount of the surfactant used is less than 20% by weight, extra costs are undesirably needed for the separation of the dispersion media other than the surfactant.

The dispersion media used for the solid builder in the present invention are particularly preferably nonionic surfactants. Examples of the nonionic surfactants usable for the dispersion media in the present invention include polyoxyethylene alkyl ethers, polyoxyethylene alkylphenyl ethers, polyoxyethylene polyoxypropylene alkyl ethers, polyoxyethylene castor oils, polyoxyethylene cured castor oils, polyoxyethylene alkylamines, glycerol alkyl ethers, glycerol polyoxyethylene alkyl ethers, higher fatty acid alkanolamides, alkylglycosides, and alkylamine oxides.

Among them, the nonionic surfactants used as a main component are preferably polyoxyethylene alkyl ethers which are ethylene oxide adducts of linear or branched, primary or secondary alcohols, each having 6 to 22 carbon atoms, preferably 10 to 15 carbon atoms, more preferably 12 to 14 carbon atoms, or ethylene oxide adducts of alkylphenyl alcohols having an alkyl chain with 6 to 22 carbon atoms, each of the ethylene oxide adducts having a molar amount of 1 to 30, preferably 1 to 20, more preferably 4 to 10 .

Among the above nonionic surfactants, a particular preference is given to the polyoxyethylene alkyl ethers which are represented by the following general formula:

$$R—(OCH_2CH_2)_nOH,$$

wherein R represents a saturated or unsaturated, linear or branched hydrocarbon group, each having 6 to 22 carbon atoms, preferably 8 to 16 carbon atoms, or an alkylphenyl group having an alkyl chain with 6 to 22 carbon atoms, preferably 8 to 18 carbon atoms; and n stands for an average number of 1 to 30, particularly preferably 1 to 20, further preferably 4 to 12.

In the present invention, the nonionic surfactants in a liquid form at 40° C. are most highly desirable because other solvents do not have to be used together. Specifically, those having 8 to 14 carbon atoms and n of 5 to 12 in average are highly desired. In the present invention, the above nonionic surfactants may be used singly or in a combination or two or more kinds. Specific examples suitably used herein include EMULGEN 108, EMULGEN 109, and EMULGEN D2585, all of which are made commercially available by Kao Corporation.

Examples of the anionic surfactants which can be used in the present invention include alkyl sulfate compounds, such as sodium lauryl sulfate, alkylethoxy sulfate compounds, alkenyl succinate compounds, and alkylbenzene sulfate compounds. Also, in the present invention, examples of the cationic surfactants which can be used in the present invention include alkyl trimethylamine salts.

Also, in the present invention, the nonionic surfactant may be singly used as a surfactant, or the nonionic surfactant may be used together with the anionic surfactant and/or the cationic surfactant. In any of the cases, the nonionic surfactant is preferably used because of its easily liquefying property. From the viewpoint of using the surfactants in detergents, it is preferred that the amount of the nonionic surfactants is 50 to 100% by weight, preferably 80 to 100% by weight of the surfactants.

In general, builders, a sort of which is used in the present invention, serve as washing aids for enhancing the actions of the surfactants when added in detergents. Examples thereof include water softeners which remove metal ions such as calcium ions acting on aliphatic acids to form precipitates slightly soluble in water, the water softeners including sodium tripolyphosphates, citric acid, zeolites, silicates, polymaleic acids, and polyacrylic acids; alkalizers for maintaining a pH of the washing liquid alkaline at conditions suitable for washing, the alkalizers including sodium carbonate and water glass; and redeposition agents for preventing the detergents from depositing to washed clothes, the redeposition agents including polymaleic acid, polyacrylic acid, and sodium tripolyphosphate. Among the above builders, the present invention is particularly concerned with solid builders at least acting as water softeners.

In the case where the silicate compounds are used for solid builders, one compound or a mixture comprising two or more of a wide variety of silicate compounds represented by the following general formula can be suitably used.

$$(Na_nK_mH_LO)\ (Ca_iMg_kO)_x(SiO_2)_y,$$

wherein n, m, and L each stands for a number of from 0 to 2, with the proviso that n+m+L equals 2; i and k each stands for a number of from 0 to 1, with the proviso that i+k equals 1; x stands for a number of from 0 to 1; and y stands for a number of from 0.9 to 3.5.

Examples of the above-defined silicate compounds may be layered sodium silicates, such as SKS-6 (manufactured by Hoechst), or crystalline sodium silicates disclosed in Japanese Patent Laid Open No. 5-184946.

In the case where the aluminosilicate compounds are used for solid builders, one compound or a mixture comprising two or more of a wide variety of aluminosilicate compounds represented by the following formula can be suitably used.

$$(Na_pK_qH_rO)_u(Ca_sMg_tO)_v(Al_2O_3)_w(SiO_2),$$

wherein p, q, and r each stands for a number of from 0 to 2, with the proviso that p+q+r equals 2; s and t each stands for a number of from 0 to 1, with the proviso that s+t equals 1; u stands for a number of from 0 to 1, preferably from 0.1 to 0.5; v stands for a number of from 0 to 1, preferably from 0 to 0.1; and w stands for a number of from 0 to 0.6, preferably from 0.1 to 0.5.

Examples of the above-defined aluminosilicate compounds include various zeolites generally used in detergents, such as ZEOLITE-A, ZEOLITE-X, and ZEOLITE-P, with a particular preference given to ZEOLITE-A.

In the wet grinding in the present invention, in the case where the solid builders are crystalline silicate compounds, a fine solid builder particle is obtained by grinding a crystalline silicate compound until one of the following conditions is satisfied:

(1) the content of particles having a particle size of 3 $\mu$m or less is 50% or more in a volume fraction, or (2) a specific surface area, calculated from a particle size distribution based on the volume fraction, is 20,000 $cm^2/cm^3$ or more.

Also, in the case where the solid builders are aluminosilicate compounds, a fine solid builder particle is obtained by grinding an aluminosilicate compound until one of the following conditions is satisfied:

(1) the content of particles having a particle size of 0.5 $\mu$m or less is 50% or more in a volume fraction, or (2) a specific surface area, calculated from a particle size distribution based on the volume fraction, is 120,000 $cm^2/cm^3$ or more.

Here, the particle size distribution based on the volume fraction is measured by a device for analyzing diameter distribution "LA-700," manufactured by Horiba Seisakusho.

The finely powdered solid builders obtained above may be separated from the suspension by filtration, centrifugation, and other means after the wet grinding.

As shown in Examples given below, calcium ion exchange speeds of the finely powdered solid builders obtained by the wet grinding according to the present invention explained above are remarkably higher than those of the solid builders which are not finely powdered.

In the builder composition of the present invention, other builders can be also used together, and the other builders may be any ones which are generally used in detergents. Examples thereof include the following:

(a) Builders and agents for capturing divalent metal ions including phosphates such as tripolyphosphates, and pyrophosphates; aminotri(methylenephosphonic acid), 1-hydroxyethylidene-1,1-diphosphonic acid, ethylenediaminetetra(methylenephosphonic acid), diethylenetriaminepenta(methylenephosphonic acid), and salts thereof; salts of phosphonocarboxylic acids, such as 2-phosphonobutane-1,2-dicarboxylic acid salts; salts of amino acids, such as salts of aspartic acid and glutamic acid; aminopolyacetates, such as nitrilotriacetates and ethylenediaminetetraacetates; polymeric electrolytes, such as polyacrylic acids, acrylic acid-maleic acid copolymers, and polyaconitic acids; non-dissociating polymers, such as polyethylene glycols, polyvinyl alcohols, and polyvinyl pyrrolidone; polyacetal carboxylic acid polymers disclosed in Japanese Patent Laid-Open No. 54-52196; salts of organic acids, such as diglycolic acid salts and hydroxycarboxylic acid salts;

(b) Alkalizers and inorganic electrolytes, such as silicates, carbonates, and sulfates; and (c) Redeposition agents, such as carboxymethyl cellulose.

In addition, amorphous aluminosilicates may be added together.

There may be other ingredients which can be contained in the detergents. For instance, caking preventives, such as paratoluenesulfonates, sulfosuccinates, talc, and calcium silicates; antioxidants such as tertiary butyl hydroxytoluene and distyrenic cresol; blueing agents; and perfume may be also contained in the detergents. The other components are not being particularly restricted, which may be blended according to the purposes used.

These builders which can be optionally added may be blended in a slurry for the wet grinding in the present invention, or they may be separately blended. In order to form powders or granules with the builder composition, the above builders may be used to form powders or granules. In the case where a nonionic surfactant having a relatively high melting point for grinding is used for a builder, the nonionic surfactant may also act as a binder, and the builder composition may be powdered or granulated by the solidifying properties of the nonionic surfactant. The builder compositions may be blended in detergent composition. For instance, the builder compositions may be dry-blended as different particles with detergent granules. Alternatively, the builder composition may be singly used in a preferred embodiment.

The detergent composition of the present invention contains the fine solid builder particle produced by the methods explained above. Specifically, the detergent composition of the present invention can be produced by the steps of carrying out wet grinding of a solid builder using a dispersion medium containing a surfactant, such as a nonionic surfactant, to give a mixture of a fine solid builder particle and the surfactant, such as the nonionic surfactant; and further adding the resulting mixture to a composition for a detergent.

The nonionic surfactants have been conventionally blended in detergent compositions, and they show excellent detergency performance as disclosed in Japanese Patent Laid-Open Nos. 5-5100 (EP-A-477974) and 6-10000 (EP-A-560395).

In the case where the surfactants mentioned above are used for a dispersion medium in wet grinding of the solid builder, the amount of the surfactants is preferably adjusted so as to provide a suitable composition to be blended in detergent products. Specifically, by adjusting the ingredients of the ground solid builder slurry containing the surfactants and adding the resulting solid builder slurry to the detergent blends, it is possible to omit the processes of drying and separating of the dispersion medium which have been conventionally required in the wet grinding method.

The weight ratio of the solid builder and the dispersion medium containing the surfactant upon wet grinding is suitably from 10:90 to 80:20, particularly from 30:70 to 60:40. Actually, the above weight ratio is also applicable for adjusting the ingredients in the detergent composition having the surfactant as a main component and the solid builder.

By producing the detergent composition according to the wet grinding in the present invention, the finely powdered solid builder can be blended in the detergent composition without carrying out a separating process by drying, depending upon its slurry composition.

In the case of the silicate compounds, this method has advantageous merits in making it possible not only to omit the drying process but also to inhibit the deterioration of alkali metal silicate compounds by always maintaining the state of coating the surface of the fine particles with the surfactants.

Also, in the case where a dispersion medium comprises a solution, such as an ethanol solution, of a surfactant, a protection effect of the surfactant can be expected by forming a coat layer with the surfactant on the surface of the particles in the drying process. Even in this case, the amount of the solvent to be vaporized can be made small when compared with the case where no surfactants are contained therein.

In addition, when ZEOLITE-A having a primary particle size of 3 $\mu$m is used as an aluminosilicate compound and ground to have a particle size of 0.4 $\mu$m (based on volume fraction), substantially no deteriorations of calcium ion exchange capacity are observed. Also, when compared to those prepared to the same particle size by a wet synthesis, well dispersed fine particles can be obtained at a low cost. Also, the resulting fine particles are well dispersed without forming agglomerated clusters of the fine particles due to drying.

As for the blending methods for the surfactant, the surfactant used in wet grinding mentioned above may be used without treatment, or the surfactant may be blended in a slurry obtained after grinding. Also, in the case of producing powder detergents, granules obtained by separately spray-drying and optionally granulating may be blended with the particles containing ground builders as separate granules.

The surfactants which are added and blended together with the fine solid builder particle in the detergent composition of the present invention are not particularly limited, as long as they are ones generally used for detergents. Specifically, they may be one or more surfactants selected from the group consisting of anionic surfactants, nonionic surfactants, cationic surfactants, and amphoteric surfactants, each of which is exemplified below. For instance, the surfactants can be chosen such that the surfactants of the same kind are chosen, as in the case where a plurality of the anionic surfactants are chosen. Alternatively, the surfactants of the different kinds are chosen, as in the case where the anionic surfactant and the nonionic surfactant are respectively chosen.

The anionic surfactants used for the detergent composition include alkylbenzenesulfonates, alkyl or alkenyl ether sulfates, alkyl or alkenyl sulfates, α-olefinsulfonates, α-sulfofatty acid salts, α-sulfofatty acid esters, alkyl or alkenyl ether carboxylates, amino acid-type surfactants, N-acyl amino acid-type surfactants, alkyl or alkenyl phosphates, and salts thereof, with a preference given to alkylbenzenesulfonates, alkyl or alkenyl ether sulfates, and alkyl or alkenyl sulfates.

Examples of the nonionic surfactants are as follows:

(1) Polyoxyethylene alkyl ethers or polyoxyethylene alkenyl ethers, each having alkyl groups or alkenyl groups with 10 to 20 average carbon atoms and having 1 to 20 mol of ethylene oxide added;

(2) Polyoxyethylene alkylphenyl ethers having alkyl groups with 6 to 12 average carbon atoms and having 1 to 20 mol of ethylene oxide added;

(3) Polyoxypropylene alkyl ethers or polyoxypropylene alkenyl ethers, each having alkyl groups or alkenyl groups with 10 to 20 average carbon atoms and having 1 to 20 mol of propylene oxide added;

(4) Polyoxybutylene alkyl ethers or polyoxybutylene alkenyl ethers, each having alkyl groups or alkenyl groups with 10 to 20 average carbon atoms and having 1 to 20 mol of butylene oxide added;

(5) Nonionic surfactants having alkyl groups or alkenyl groups with 10 to 20 average carbon atoms and having 1 to 30 mol in total of ethylene oxide and propylene oxide or ethylene oxide and butylene oxide added (the molar ratio of ethylene oxide to propylene oxide or that of ethylene oxide to butylene oxide being from 0.1/9.9 to 9.9/0.1);

(6) Higher fatty acid alkanolamides or alkylene oxide adducts thereof represented by the following general formula:

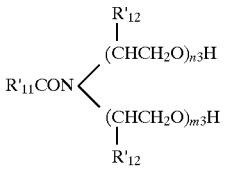

wherein $R'_{11}$ is an alkyl group or alkenyl group, each having 10 to 20 carbon atoms; $R'_{12}$ is an H atom or a $CH_3$ group; n3 is an integer of 1 to 3; and m3 is an integer of 0 to 3;

(7) Sugar fatty acid esters formed between sugar and a fatty acid with 10 to 20 average carbon atoms;

(8) Fatty acid glycerol monoesters formed between glycerol and a fatty acid with 10 to 20 average carbon atoms; and (9) Alkylamine oxides represented by the following general formula:

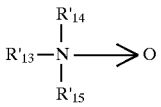

wherein $R'_{13}$ is an alkyl group or alkenyl group, each having 10 to 20 average carbon atoms; and $R'_{14}$ and $R'_{15}$ each is an alkyl group having 1 to 3 carbon atoms.

Among the nonionic surfactants, a particular preference is given to the polyoxyethylene alkyl ethers which are ethylene oxide adducts of linear or branched, primary or secondary alcohols, each having 10 to 20 average carbon atoms and having an average molar number of from 5 to 15 mol of ethylene oxide added. Particularly, a greater preference is given to the polyoxyethylene alkyl ethers which are ethylene oxide adducts of linear or branched, primary or secondary alcohols, each having 12 to 14 average carbon atoms and having an average molar number of from 6 to 10 mol of ethylene oxide added.

Examples of the cationic surfactants include quaternary ammonium salts. Examples of the amphoteric surfactants include carboxy-type and sulfobetaine-type amphoteric surfactants.

The most preferred detergent composition in the present invention comprises a nonionic surfactant as a main component, which may be prepared by grinding the builder explained above using a nonionic surfactant containing no water, and optionally adding oil-absorbing carriers such as porous silica compounds and porous spray-dried particles to form into particles by powdering or granulation. Of course, the above particles may be post-blended with the particles comprising anionic surfactants as a main component.

In the detergent composition, the following components may be also be incorporated. Specifically, enzymes, such as protease, lipase, and cellulose; caking preventives, such as paratoluenesulfonates, sulfosuccinates, talc, and calcium silicates; antioxidants, such as tertiary butyl hydroxytoluene and distyrenic cresols; fluorescent dyes; blueing agents; and perfume may be incorporated thereto. The other components are not being particularly restricted, which may be added according to the purposes used.

Here, an enzyme, a bleaching agent, or a bleaching activator is generally dry-blended with the detergent granules as separate granules. Methods for preparing the detergent composition can be referred to Japanese Patent Laid-Open Nos. 60-96698, 61-69897, 61-69898, 61-69899, 61-69900, 62-169900, and 5-209200.

The present invention will be explained in detail by means of Examples and Comparative Examples, without intending the scope of the present invention to these Examples.

EXAMPLE 1

Two-hundred parts by weight of a commercially available layered sodium silicate SKS-6 (manufactured by Hoechst, volume mean particle size: 40 μm) were suspended in 200 parts by weight of $C_{12}H_{25}(OC_2H_4)_{2\text{-}10}OH$ (EMULGEN 109, manufactured by Kao Corporation), and the obtained slurry was ground at a grinding temperature of 60° C. using a batch-type sand mill having a one-liter capacity (manufactured by Aimex K.K.). As for the media, 1400 parts by weight of titania beads having a 0.8 mm diameter were used. The slurry was ground for 4 hours at a disc rotational speed of 2000 rpm, and the ground slurry was partially taken out and diluted with ethanol to measure a particle size distribution (based on a volume fraction) of sodium silicate using a device for analyzing particle size distribution LA-700 manufactured by Horiba Seisakusho. As a result, the volume mean particle size was 1.2 μm. The particle size distribution thereof is as shown in Table 1. The histogram of the particle size distribution is given in FIG. 1. Assuming that the particles have smooth surfaces, the specific surface area calculated from the particle size distribution was about 61000 $cm^2/cm^3$. Also, the particles of 3 μm or less occupied 97% of the entire particles.

TABLE 1

| Division No. | Typical Particle Size (μm) | Volume Fraction (%) |
|---|---|---|
| #1 | 6.72 | 0.00 |
| #2 | 5.87 | 0.10 |
| #3 | 5.12 | 0.30 |
| #4 | 4.47 | 0.60 |
| #5 | 3.90 | 0.80 |
| #6 | 3.41 | 1.20 |
| #7 | 2.98 | 1.70 |
| #8 | 2.60 | 2.40 |
| #9 | 2.27 | 3.90 |
| #10 | 1.98 | 6.30 |
| #11 | 1.73 | 9.60 |
| #12 | 1.51 | 13.10 |
| #13 | 1.32 | 14.80 |
| #14 | 1.15 | 13.70 |
| #15 | 1.00 | 10.60 |
| #16 | 0.88 | 7.40 |
| #17 | 0.77 | 4.50 |
| #18 | 0.67 | 2.50 |
| #19 | 0.58 | 1.50 |
| #20 | 0.51 | 0.90 |
| #21 | 0.45 | 0.70 |
| #22 | 0.39 | 0.50 |
| #23 | 0.34 | 0.50 |
| #24 | 0.30 | 0.40 |
| #25 | 0.26 | 0.40 |
| #26 | 0.23 | 0.40 |
| #27 | 0.20 | 0.30 |
| #28 | 0.17 | 0.30 |
| #29 | 0.15 | 0.20 |
| #30 | 0.13 | 0.20 |
| #31 | 0.11 | 0.20 |
| #32 | 0.10 | 0.10 |
| #33 | 0.09 | 0.00 |

EXAMPLE 2

Three-thousand parts by weight of the same layered sodium silicate SKS-6 as in Example 1 were suspended in 3000 parts by weight of $C_{12}H_{25}(OC_2H_4)_{0-9}OH$ (EMULGEN 108, manufactured by Kao Corporation), and the obtained slurry was ground using a continuous-type sand mill (DYNO-MILL, manufactured by Shinmaru Enterprises Corporation). The volume mean particle size of sodium silicate in the slurry obtained for an overall residence time of 10 minutes was 1.4 μm. The specific surface area calculated from the particle size distribution was about 49000 $cm^2/cm^3$. Also, the particles of 3 μm or less occupied 93% of the entire particles.

EXAMPLE 3

Two-hundred parts by weight of the same layered sodium silicate SKS-6 as in Example 1, 30 parts by weight of sodium laurylbenzene sulfonate, and 170 parts by weight of methanol were mixed and then ground for 4 hours by a method similar to that of Example 1. The volume mean particle size of sodium silicate of the obtained slurry was 1.2 μm. The specific surface area calculated from the particle size distribution was about 63000 $cm^2/cm^3$. Also, the particles of 3 μm or less occupied 98% of the entire particles.

EXAMPLE 4

One-thousand grams of No. 1 water glass, manufactured by Osaka Keiso K.K. ($SiO_2/Na_2O$=2.1), 46 g of sodium hydroxide, 25 g of potassium hydroxide, 4.6 g of calcium hydroxide, and 0.2 g of magnesium hydroxide were mixed and stirred, and then baked over a period of 3 hours at 700° C. The resulting alkali metal silicate compound was roughly ground to about a diameter of 15 μm using a vibrating mill. Two-hundred grams of the above alkali metal silicate compound were suspended in $CH_3(CH_2)_{12-13}(OC_2H_4)_{0-11}OH$ (EMULGEN D2585, manufactured by Kao Corporation), and then ground over a period of 4 hours by a method similar to that of Example 1. As a result, a slurry containing alkali silicate compounds having a volume mean particle size of 1.4 μm was obtained. The specific surface area calculated from the particle size distribution was about 51000 $cm^2/cm^3$. Also, the particles of 3 μm or less occupied 93% of the entire particles.

Comparative Example 1

Two-hundred grams of the layered sodium silicate SKS-6 were intermittently ground over a period of one hour using a vibrating mill (capacity 1000 cc; manufactured by Chuo Kakoki) loaded with 1.5 kg of zirconia media having a 10 mm-diameter. The resulting powder was dispersed in ethanol to measure a volume mean particle size by using the device for analyzing particle size distribution as in Example 1. As a result, the volume mean particle size was 10.9 μm. The particle size distribution thereof is as shown in Table 2. The specific surface area calculated from the particle size distribution was about 7400 $cm^2/cm^3$. Also, the particles of 3 μm or less occupied 5% of the entire particles.

TABLE 2

| Division No. | Typical Particle Size (μm) | Volume Fraction (%) |
|---|---|---|
| #1 | 101.40 | 0.0 |
| #2 | 88.58 | 0.1 |
| #3 | 77.34 | 0.2 |
| #4 | 67.52 | 0.3 |
| #5 | 58.95 | 0.4 |
| #6 | 51.47 | 0.6 |
| #7 | 44.94 | 0.9 |
| #8 | 39.23 | 1.3 |
| #9 | 34.25 | 1.9 |
| #10 | 29.91 | 2.7 |
| #11 | 26.11 | 3.7 |
| #12 | 22.80 | 5.0 |
| #13 | 19.90 | 6.1 |
| #14 | 17.38 | 7.1 |
| #15 | 15.17 | 7.9 |
| #16 | 13.25 | 8.2 |
| #17 | 11.56 | 8.2 |
| #18 | 10.10 | 7.9 |
| #19 | 8.82 | 7.2 |
| #20 | 7.70 | 6.1 |
| #21 | 6.72 | 4.9 |
| #22 | 5.87 | 4.1 |
| #23 | 5.12 | 3.6 |
| #24 | 4.47 | 3.0 |
| #25 | 3.90 | 2.1 |
| #26 | 3.41 | 1.6 |
| #27 | 2.98 | 1.3 |
| #28 | 2.60 | 1.2 |
| #29 | 2.27 | 1.0 |
| #30 | 1.98 | 0.7 |
| #31 | 1.73 | 0.5 |
| #32 | 1.51 | 0.2 |
| #33 | 1.32 | 0.1 |
| #34 | 1.15 | 0.0 |

EXAMPLE 5

Figure 2:
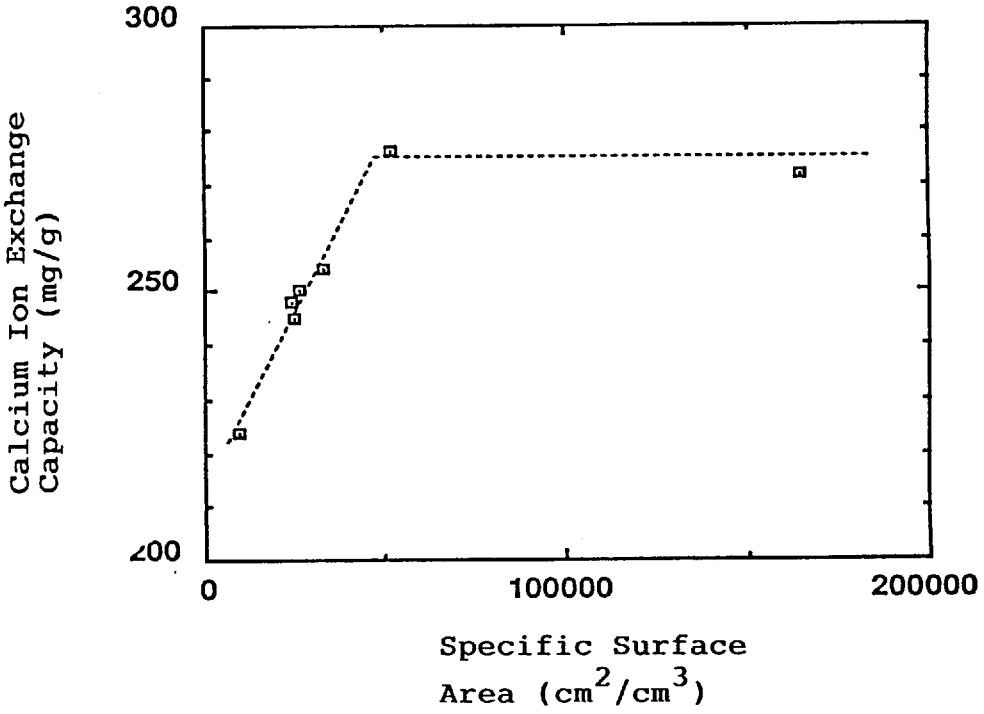
FIG. 2 is a graph showing the relationship between the calcium ion exchange capacity and the specific surface area of the fine solid builder particles having various particle sizes in Example 5.

The layered sodium silicate SKS-6 was used, and various kinds of slurry having different grain diameter distribution and specific surface area were obtained by a method similar to that of Example 1 mentioned above except that the grinding time was changed. The water softening ability of sodium silicate in each of the slurry was measured. Here, the water softening ability was measured by placing the above surfactant slurry containing 1 g of the alkali metal silicate compound in one liter of a 280 ppm (calculated as CaO) aqueous solution filtering the solution at a point after immersing and stirring for 15 minutes, and measuring the amount of calcium in the filtrate. The results thereof are shown in FIG. 2. The results are such that an amount of CaO captured in the alkali metal silicate compound is expressed by calculating it as a weight of an equimolar amount of $CaCO_3$. Also, the calcium ion exchange capacity under the same measurement conditions for the layered sodium silicate SKS-6 was 221 mg/g. As is clear from FIG. 2, an excellent calcium ion exchange capacity was observed when the specific surface area was 20000 $cm^2/cm^3$ or more.

Comparative Example 2

Fifty grams of the layered sodium silicate SKS-6 were suspended in 200 g of ethanol, and the suspension was intermittently ground over a period of one hour using a vibrating mill loaded with 1.5 kg of zirconia media having a 10 mm-diameter. A part of the obtained slurry was diluted with ethanol to measure a volume mean particle size by using the device for analyzing particle size distribution as in the same manner as Example 1. As a result, the volume mean particle size was 3.5 $\mu$m. The obtained slurry was dried using a rotary evaporator to measure the water softening ability by a method similar to that of Example 5. As a result, the water softening ability was 219 mg/g. The water softening ability of sodium silicate SKS-6 having a volume mean particle size of 40 $\mu$m before grinding treatment was 221 mg/g as mentioned above. Further, the water softening ability measured for sodium silicate obtained in Comparative Example 1 was 223 mg/g.

EXAMPLE 6

Two-hundred grams of the layered sodium silicate SKS-6 were suspended in 200 g of a 22% ethanol solution of EMULGEN D2585, and the suspension was ground by a method similar to that of Example 1 until a volume mean particle size of sodium silicate reached 1.0 $\mu$m. The ground mixture was dried over a rotary evaporator to give powder, and then stored under environmental conditions of 20° C., 50% RH for 24 hours. The water softening ability of sodium silicate in the powder was measured by a method similar to that of Example 5, and it was found to be 251 mg/g.

Comparative Example 3

Two-hundred grams of the layered sodium silicate SKS-6 were suspended in 200 g of a 5% ethanol solution of EMULGEN D2585, and the suspension was ground by a method similar to that of Example 1 until a volume mean particle size of sodium silicate reached 1.0 $\mu$m. The ground mixture was dried over a rotary evaporator to give powder, and then stored under environmental conditions of 20° C., 50% RH for 24 hours. The water softening ability of sodium silicate in the powder was similarly measured, and it was found to be 210 mg/g.

EXAMPLE 7

Two-hundred grams of commercially available zeolite-A (TOYOBUILDER, manufactured by Tosoh Corporation, volume mean particle size: 3 $\mu$m) as an aluminosilicate compound were suspended in 200 g of EMULGEN 109 (manufactured by Kao Corporation), and the suspension was ground by using a batch-type sand mill having a one-liter capacity (manufactured by Aimex K.K.) loaded with 1400 g of titania beads having a 0.8 mm-diameter. The suspension was ground for 4 hours at a disc rotational speed of 2000 rpm, and the obtained slurry was then diluted with water to measure the particle size of the zeolite in the same manner as in Example 1. As a result, the zeolite having a volume mean particle size of 0.37 $\mu$m was obtained. The specific surface area calculated from the particle size distribution was about 197000 $cm^2/cm^3$. The water softening ability of the fine zeolite particle was measured by a method similar to that of Example 5 after immersing the zeolite in hard water for 15 minutes, and it was found to be 238 mg/g. However, the calcium ion exchange capacity after immersing the zeolite for 5 minutes already reached 236 mg/g.

Comparative Example 4

The same zeolite used in Example 7 was ground by a method similar to that of Comparative Example 1 using a vibrating mill loaded with 1.5 kg of zirconia media having a 10-mm diameter. The resulting powder was dispersed in water to measure a particle size of the zeolite by using the device for analyzing particle size distribution mentioned above. As a result, the volume mean particle size of the zeolite was 1.4 $\mu$m. The specific surface area calculated from the particle size distribution was about 97000 $cm^2/cm^3$. The water softening ability of the fine zeolite particle was measured by a method similar to that of Example 5 after immersing the zeolite in hard water for 15 minutes, and it was found to be 234 mg/g. However, the calcium ion exchange capacity after immersing the zeolite for 5 minutes was 199 mg/g.

Comparative Example 5

Two-hundred grams of the same zeolite used in Example 7 were suspended in 200 g of water, and 2 g of EMULGEN 108 (manufactured by Kao Corporation) was added to the mixture, and the resulting suspension was ground by a method similar to that of Example 7. The suspension was ground for 4 hours at a disc rotational speed of 2000 rpm, and the obtained slurry was then diluted with water to measure the particle size of the zeolite in the same manner as in Example 7. As a result, the zeolite having a volume mean particle size of 0.38 $\mu$m was obtained. The specific surface area calculated from the particle size distribution was about 195000 $cm^2/cm^3$. The water softening ability of the fine zeolite particle was measured by a method similar to that of Example 5 after immersing the zeolite in hard water for 15 minutes, and it was found to be 109 mg/g.

Comparative Example 6

Two-hundred grams of the same zeolite used in Example 7 were suspended in a dispersion medium having a composition comprising 80 g of water, 20 g of EMULGEN D2585, and 100 g of ethanol, and the suspension was ground by a method similar to that of Example 7. The suspension was ground for 4 hours at a disc rotational speed of 2000 rpm, and the obtained slurry was then diluted with water to measure the particle size of the zeolite in the same manner as in Example 7. As a result, the zeolite having a volume mean particle size of 0.4 $\mu$m was obtained. The specific surface area calculated from the particle size distribution was about 192000 $cm^2/cm^3$. The water softening ability of the fine zeolite particle was measured by a method similar to that of Example 5 after immersing the zeolite in hard water for 15 minutes, and it was found to be 1456 mg/g.

Incidentally, the experiments concerning the water softening ability in Examples 5 to 7 and Comparative Examples 2 to 6 above were conducted using a 280 ppm aqueous solution, calculated as CaO, and similar tendencies would be observed when using a 20 ppm aqueous solution, calculated as CaO. Although a commercially available zeolite generally would have a higher calcium ion exchange speed than a commercially available silicate compound, as clearly shown in Example 7 above, the fine zeolite particle by the method of the present invention showed even a higher calcium ion exchange speed. In a presently standard washing method by a machine wash, the washing time for clothes would be normally about 15 minutes. Therefore, the calcium concentration of the washing fluids at an early point after the start of washing, namely within 5 minutes from the start of washing, would determine the detergency efficiency, so that the above results are remarkably advantageous in the practical level.

EXAMPLE 8

The fine solid builder particle/EMULGEN 108 slurry obtained in Example 2 was used without post-treatments such as drying, etc., and a detergent composition was produced by the following method.

Specifically, 15 parts by weight of an amorphous aluminosilicate commercially available under a trade name of TIXOLEX 25 (manufactured by Kofran Chemical) were placed in a batch-type agitation tumbling granulator (LÖDIGE MIXER, manufactured by Matsusaka Giken). Next, while agitating and tumbling, 60 parts by weight of the fine solid builder particle/EMULGEN 108 slurry heated at 60° C. were sprayed, and then the sprayed particles were agitated and tumbled. In the obtained mixture, additional 4 parts by weight of TIXOLEX 25 were mixed, and the mixture was further agitated and tumbled for one minute, to give a powder detergent composition having a particle size of about 300 μm.

EXAMPLE 9

The fine solid builder particle/EMULGEN D2585 slurry obtained in Example 4 was used without post-treatments such as drying, etc., and a detergent composition was produced by the following method.

Specifically, 15 parts by weight of an amorphous aluminosilicate commercially available under a trade name of TIXOLEX 25 (manufactured by Kofran Chemical) were placed in a batch-type agitation tumbling granulator (LÖDIGE MIXER, manufactured by Matsusaka Giken). Next, while agitating and tumbling, 60 parts by weight of the fine solid builder particle/EMULGEN D2585 slurry heated at 60° C. were sprayed, and then the sprayed particles were agitated and tumbled. In the obtained mixture, additional 4 parts by weight of TIXOLEX 25 were mixed, and the mixture was further agitated and tumbled for one minute, to give a powder detergent composition having a particle size of about 300 μm.

EXAMPLE 10

The fine solid builder particle/EMULGEN 109 slurry obtained in Example 7 was used without post-treatments such as drying, etc., and a detergent composition was produced by the following method.

Specifically, 15 parts by weight of an amorphous aluminosilicate commercially available under a trade name of TIXOLEX 25 (manufactured by Kofran Chemical) and 30 parts by weight of anhydrous sodium carbonate were placed in an agitation tumbling granulator (LÖDIGE MIXER, manufactured by Matsusaka Giken). Next, while agitating and tumbling, 60 parts by weight of the fine solid builder particle/EMULGEN 109 slurry heated at 60° C. were sprayed, and then the sprayed particles were agitated and tumbled. In the obtained mixture, additional 4 parts by weight of TIXOLEX 25 were mixed, and the mixture was further agitated and tumbled for one minute, to give a powder detergent composition having a particle size of about 300 μm.

Comparative Example 7

Thirty parts by weight of SKS-6 (volume mean particle size: 70 μm) and 15 parts by weight of TIXOLEX 25 were placed in a batch-type agitation tumbling granulator. While agitating and tumbling, 30 parts by weight of EMULGEN 108 heated at 60° C. were sprayed, and then the sprayed particles were agitated and tumbled. In the obtained mixture, additional 4 parts by weight of TIXOLEX 25 were mixed, and the mixture was further agitated and tumbled for one minute, to give a powder detergent composition having a particle size of about 300 μm.

Comparative Example 8

Thirty parts by weight of ZEOLITE 4A (volume mean particle size: 3 μm), 15 parts by weight of TIXOLEX 25, and 30 parts by weight of anhydrous sodium carbonate were placed in a batch-type agitation tumbling granulator. While agitating and tumbling, 30 parts by weight of EMULGEN 109 heated at 60° C. were sprayed, and the sprayed particles were then agitated and tumbled. In the obtained mixture, additional 4 parts by weight of TIXOLEX 25 were mixed, and the mixture was further agitated and tumbled for one minute, to give a powder detergent composition having a particle size of about 300 μm.

Comparative Example 9

31.5 parts by weight of a fine solid builder particle/EMULGEN D2585 mixture obtained in Comparative Example 3 and 15 parts by weight of TIXOLEX 25 were placed in a batch-type agitation tumbling granulator. While agitating and tumbling, 28.5 parts by weight of EMULGEN D2585 heated at 60° C. were sprayed, and then the sprayed particles were agitated and tumbled for a total period of 10 minutes. In the obtained mixture, additional 4 parts by weight of TIXOLEX 25 were mixed, and the mixture was further agitated and tumbled for one minute, to give a powder detergent composition having a particle size of about 300 μm.

Comparative Example 10

30.3 parts by weight of a fine solid builder particle/EMULGEN 108 mixture, the mixture being prepared by drying the fine solid builder particle obtained in Comparative Example 5 using a rotary evaporator, 15 parts by weight of TIXOLEX 25, and 30 parts by weight of anhydrous sodium carbonate were placed in a batch-type agitation tumbling granulator. While agitating and tumbling, 29.7 parts by weight of EMULGEN 109 heated at 60° C. were sprayed, and the sprayed particles were then agitated and tumbled. In the obtained mixture, additional 4 parts by weight of TIXOLEX 25 were mixed, and the mixture was further agitated and tumbled for one minute, to give a powder detergent composition having a particle size of about 300 μm.

Detergency Test

Detergency of each of the powdery detergent compositions obtained in Examples 8 through 10 and Comparative Examples 7 through 10 was measured by the following methods. The results are shown in Table 3. It was shown that the present inventive products had excellent detergency.

Sebum/Carbon Stained Clothes (Artificially Stained Clothes)

| (Model Sebum/Carbon Dirt Composition) | |
|---|---|
| Carbon black | 15% |
| Cotton seed oil | 60% |
| Cholesterol | 5% |
| Oleic acid | 5% |

-continued

| (Model Sebum/Carbon Dirt Composition) | |
|---|---|
| Palmitic acid | 5% |
| Liquid paraffin | 10% |

One kilogram of the above-mentioned composition is dissolved and dispersed in 80 liters of PERCLENE. A calico #2023 cloth is immersed therein to adhere the stains, and PERCLENE is removed by drying.

Detergency Conditions

To one liter of aqueous solution of detergents for evaluation, five 10 cm×10 cm pieces each of sebum/carbon stained cotton cloth were placed therein, and they were washed using a turgometer at 100 rpm under the following detergency conditions:

| | |
|---|---|
| Detergency Time | 10 minutes; |
| Concentration of Detergent: | Concentration of powder detergent having 0.03% of surfactant concentration; |
| Hardness of Water | 4° DH; |
| Water Temperature | 20° C.; and |
| Rinsing | in tap water for 5 minutes. |

Evaluation Method of Detergency Test

Reflectivities of the original cloth before staining and those of the stained cloth before and after the washing were measured at 550 nm by means of an automatic recording calorimeter (manufactured by Shimadzu Corporation), and the detergency rate (%) was calculated by the following equation.

$$\text{Detergency Rate (\%)} = \frac{\text{Reflectivity after washing} - \text{Reflectivity before washing}}{\text{Reflectivity of the original cloth} - \text{Reflectivity before washing}} \times 100$$

TABLE 3

| | | Present Inventive Product Example No. | | | Comparative Product Comparative Example No. | | | |
|---|---|---|---|---|---|---|---|---|
| | | 8 | 9 | 10 | 7 | 8 | 9 | 10 |
| Fine Solid Builder Particle of Example 2 | SKS-6 | 30 } 60 | | | | | | |
| | EMULGEN 108 | 30 | | | | | | |
| Fine Solid Builder Particle of Example 4 | Crystalline Silicate | | 30 } 60 | | | | | |
| | EMULGEN D2585 | | 30 | | | | | |
| Fine Solid Builder Particle of Example 7 | Zeolite | | | 30 } 60 | | | | |
| | EMULGEN 109 | | | 30 | | | | |
| SKS-6 | (15 μm) | | | | 30 | | | |
| ZEOLITE 4A | (3 μm) | | | | | 30 | | |
| Fine Solid Builder Particle of Comp. Example 3 | SKS-6 | | | | | | 30 } 31.5 | |
| | EMULGEN D2585 | | | | | | 1.5 | |
| Fine Solid Builder Particle of Comp. Example 5 | Zeolite | | | | | | | 30 } 30.3 |
| | EMULGEN 108 | | | | | | | 0.3 |
| Nonionic Surfactant | | | | | 30 | 30 | 28.5 | 29.7 |
| Amorphous Sodium Aluminosilicate | | 15 + 4 | 15 + 4 | 15 + 4 | 15 + 4 | 15 + 4 | 15 + 4 | 15 + 4 |
| Soda Ash | | | | 30 | | 30 | | 30 |
| Detergency Rate (%) | | 81 | 80 | 83 | 65 | 72 | 69 | 71 |

INDUSTRIAL APPLICABILITY

According to the method of the present invention, the fine solid builder particle having a higher calcium ion exchange capacity than conventional ones can be easily obtained. Further, a builder composition and a detergent composition containing the above fine solid builder particle can be obtained.

We claim:

1. A method for producing a fine solid builder particle comprising the steps of suspending a solid builder in a dispersion medium containing 20 to 100% by weight of a surfactant, and carrying out wet grinding of the solid builder.

2. The method for producing a fine solid builder particle according claim 1, wherein 50 to 100% by weight of the surfactant is a nonionic surfactant.

3. The method for producing a fine solid builder particle according to claim 2, wherein the nonionic surfactant is one or more compounds represented by the following general formula:

$$R—(OCH_2CH_2)_nOH,$$

wherein R stands for a saturated or unsaturated, linear or branched hydrocarbon group, each having 6 to 22 carbon atoms, or an alkylphenyl group having an alkyl chain with 6 to 22 carbon atoms; and n stands for a number of 1 to 30.

4. The method for producing a fine solid builder particle according to claim 1, wherein said dispersion medium consists essentially of one or more surfactants and one or more organic solvents, said organic solvents being selected from the group consisting of lower alcohols having 1 to 4 carbon atoms; ethylene oxide and/or propylene oxide adducts of said lower alcohols; ethylene oxide and/or propylene oxide adducts of phenol; ketones; toluene; and ethers.

5. The method for producing a fine solid builder particle according to claim 1, wherein the dispersion medium contains substantially no water.

6. The method for producing a fine solid builder particle according to claim 1, wherein the solid builder contains, as a main component thereof, one or more crystalline silicate compounds represented by the following general formula:

$$(Na_nK_mH_LO)\ (Ca_iMg_kO)_x(SiO_2)_y,$$

wherein n, m, and L each stands for a number of from 0 to 2, with the proviso that n+m+L equals 2; i and k each stands for a number of from 0 to 1, with the proviso that i+k equals 1; x stands for a number of from 0 to 1; and y stands for a number of from 0.9 to 3.5.

7. The method for producing a fine solid builder particle according to claim 6 wherein the grinding step of the solid builder is carried out until one of the following conditions is satisfied:

(1) the content of particles having a particle size of 3 $\mu$m or less is 50% or more in a volume fraction, or (2) a specific surface area, calculated from a particle size distribution based on the volume fraction, is 20,000 $cm^2/cm^3$ or more.

8. A builder composition comprising the fine solid builder particle obtained by the method according to claim 6.

9. A detergent composition comprising the fine solid builder particle obtained by the method according to claim 6, and one or more surfactants selected from the group consisting of anionic surfactants, nonionic surfactants, cationic surfactants and amphoteric surfactants.

10. The method for producing a fine solid builder particle according to claim 1, wherein the solid builder contains, as a main component thereof, one or more aluminosilicate compounds represented by the following general formula:

$$(Na_pK_qH_rO)_u(Ca_sMg_tO)_v(Al_2O_3)_w(SiO_2),$$

wherein p, q, and r each stands for a number of from 0 to 2, with the proviso that p+q+r equals 2; s and t each stands for a number of from 0 to 1, with the proviso that s+t equals 1; u stands for a number of from 0 to 1; v stands for a number of from 0 to 1; and w stands for a number of from 0 to 0.6.

11. The method for producing a fine solid builder particle according to claim 10, wherein the grinding step of the solid builder is carried out until one of the following conditions is satisfied:

(1) the content of particles having a particle size of 0.5 $\mu$m or less is 50% or more in a volume fraction, or (2) a specific surface area, calculated from a particle size distribution based on the volume fraction, is 120,000 $cm^2/cm^3$ or more.

12. A builder composition containing the fine solid builder particle obtained by the method according to claim 10, the fine solid builder particle comprising an aluminosilicate compound having the following properties:

(1) the content of particles having a particle size of 0.5 $\mu$m or less is 50% or more in a volume fraction, or (2) a specific surface area, calculated from a particle size distribution based on the volume fraction, is 120,000 $cm^2/cm^3$ or more.

13. A detergent composition comprising the fine solid builder particle obtained by the method according to claim 10, the fine solid builder particle comprising an aluminosilicate compound having the following properties:

(1) the content of particles having a particle size of 0.5 $\mu$m or less is 50% or more in a volume fraction, or (2) a specific surface area, calculated from a particle size distribution based on the volume fraction, is 120,000 $cm^2/cm^3$ or more; and one or more surfactants selected from the group consisting of anionic surfactants, nonionic surfactants, cationic surfactants and amphoteric surfactants.

14. A method for producing a detergent composition comprising the steps of carrying out wet grinding of a solid builder using a dispersion medium containing 20 to 100% by weight of a surfactant to give a mixture of a fine solid builder particle and the surfactant, and further adding the mixture to a composition for a detergent.

15. The method for producing a detergent composition according to claim 14, wherein the surfactant is a nonionic surfactant.

16. The method for producing a detergent composition according to claim 15, wherein the nonionic surfactant is one or more compounds represented by the following general formula:

$$R—(OCH_2CH_2)_nOH,$$

wherein R stands for a saturated or unsaturated, linear or branched hydrocarbon group, each having 6 to 22 carbon atoms, or an alkylphenyl group having an alkyl chain with 6 to 22 carbon atoms; and n stands for a number of 1 to 30.

* * * * *